United States Patent [19]

Holson

[11] 4,294,029

[45] Oct. 13, 1981

[54] PIVOTALLY MOUNTED PHOTO ALBUM PAGE

[75] Inventor: Sheldon Holson, Wilton, Conn.

[73] Assignee: The Holson Company, Wilton, Conn.

[21] Appl. No.: 161,213

[22] Filed: Jun. 19, 1980

[51] Int. Cl.[3] ..... B42F 17/00

[52] U.S. Cl. ..... 40/388; 40/530

[58] Field of Search ..... 40/388, 530, 536, 537, 40/158

[56] References Cited

U.S. PATENT DOCUMENTS

| | | | |
|---|---|---|---|
| 2,850,294 | 9/1958 | Ortis et al. | 40/530 |
| 3,257,128 | 6/1966 | Schneider | 281/39 |
| 3,461,585 | 8/1969 | Roberts | 40/158 |
| 3,831,301 | 8/1974 | Reynard | 40/536 |

FOREIGN PATENT DOCUMENTS

| | | | |
|---|---|---|---|
| 1514171 | 1/1968 | France | 40/537 |

*Primary Examiner*—Gene Mancene
*Assistant Examiner*—Wenceslao J. Contrera
*Attorney, Agent, or Firm*—Charles E. Temko

[57] ABSTRACT

A photo album page of the type including a laminated base having means for engaging on each side thereof a photograph supporting frame element. The mounting edge of the page is provided with hinged means formed by a pair of tape strips which engage the base along one side thereof, and an extruded hollow channel forming member along a second side thereof. A relatively stiff wire engages the channel forming member to be frictionally retained therein, the free edges of the wire projecting from the channel to selectively engage a known binding.

2 Claims, 4 Drawing Figures

PIVOTALLY MOUNTED PHOTO ALBUM PAGE

BACKGROUND OF THE INVENTION

This invention relates generally to the field of photograph albums, and more particularly to an improved form of album page of a type having a projecting wire at the inner ends of the upper and lower edges thereof for engaging a binder in pivotal association. Devices of this type are exemplified in the United States patent to Roberts, U.S. Pat. No. 3,461,585 granted Aug. 19, 1969.

While very attractive and useful, prior art pages of this type have been assembled substantially entirely by hand operations, causing the cost of fabrication to limit public acceptance. This is particularly true in the formation of the hinge member wherein, as illustrated in the abovementioned Roberts patent, comprises one relatively wide strip of adhesive tape engaging both surfaces of the laminated page, and enclosing the elongated wire in a laterally medially disposed folded area. The fact that the tape is uniformly coated with a suitable adhesive prevents the tape from being installed as an in-line operation with subsequent insertion of the wire. Rather, one half of the tape is pressed into position, the wire segment subsequently positioned, and the tape is then folded about the wire and secured to an oppositely disposed surface of the page. Extreme care is necessary to form the fold accurately, and assembly time is correspondingly long.

SUMMARY OF THE INVENTION

Briefly stated, the invention contemplates the provision of an improved album page of the class described in which the abovementioned disadvantage has been substantially eliminated. The folded portion of the tape is no longer required, being substituted by a separate synthetic resinous extrusion including a generally planar body, one longitudinal edge of which is provided with a hollow channel forming bead which frictionally retains the wire, the wire being inserted after the extrusion has been integrated with the page using a pair of relatively narrow tapes. During such integration, the pages may be serially fed to a station where the extrusion is fed as a continuous web, and is positioned adjacent the mounting edge of the page, and the tapes are pressed into position above and below the opposed surfaces of the extrusion and the page. After trimming of integrated page and extrusion, the wire may be manually inserted in the preformed channel to complete the assembly. Thus, the only manual operation required is this last-mentioned step.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
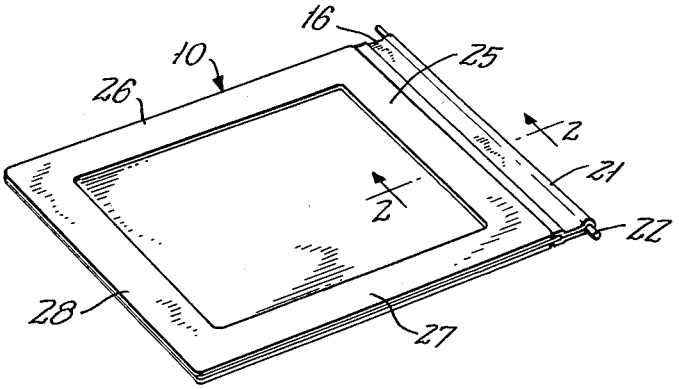
FIG. 1. PRIOR ART
FIG. 1 is a view in perspective of a completed photograph album page made in accordance with the teachings of the prior art.
Figure 2:
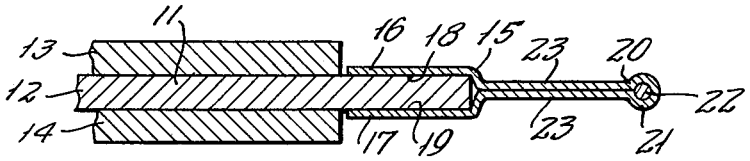
FIG. 2. PRIOR ART
FIG. 2 is a fragmentary sectional view as seen from the plane 2—2 in FIG. 1.

Before entering into a description of the present invention, a brief discussion of the prior art is considered apposite. Referring to FIG. 1 in the drawing, a known page element is illustrated as disclosed in the abovementioned Roberts patent.

The completed prior art page, generally indicated by reference character 10 includes a laminated page element 11 which may include a central lamina 12 to which outer laminae 13 and 14 are interconnected by gluing or sewing. A single adhesive tape strip 15 includes first and second edge portions 16 and 17 which are adhered to opposed surfaces 18 and 19 of the page element 11.

A central portion 20 of the tape strip 15 is folded laterally medially to form a loop 21 enclosing a wire 22, the ends of which project outwardly from the upper and lower edges of the page element in known manner. Adjacent the wire 22 are mutually abutting portions 23 which serve to anchor the wire 22 in position and space the page element 11 from the wire. As seen in FIG. 1, the page 10 is normally of rectangular configuraton, including a bound edge 25, free side edges 26 and 27, and a free end edge 28.

As has been mentioned, this structure cannot be assembled as an on line operation. An operator must take the individual page elements, secure one edge portion of the tape strip 15 to one of the surfaces 18–19, manually position the wire 22 on a longitudinal medial line, and fold the tape upon itself to anchor a corresponding side area of the tape strip to the opposed surface 18–19. It will be readily appreciated that this operation cannot be performed with any degree of rapidity, since the tape strip must first be severed from a web, and the wire accurately positioned.

Figure 3:
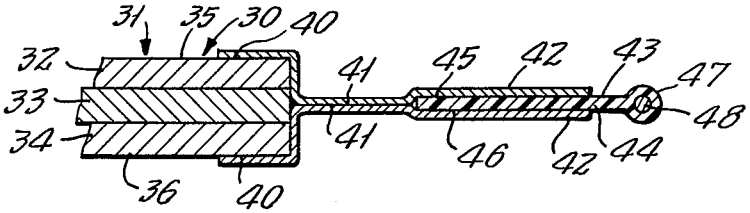
FIG. 3 is a fragmentary sectional view corresponding to that seen in FIG. 2, but showing an embodiment of the invention.
Figure 4:
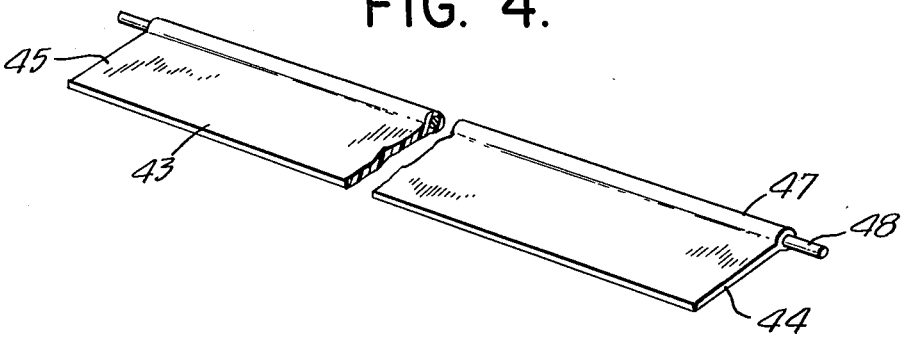
FIG. 4 is a fragmentary view in perspective of a synthetic resinous extrusion forming a part of the embodiment.

Referring to FIGS. 3 and 4 in the drawing, the problem of serial assembly is solved by the provision of an extruded channel forming member which may be fed from a web and severed at proper intervals to be integrated to the bound edge of the album page by a pair of adhesive strips, both of which are also severed from appropriate web feeds (not shown).

The embodiment, generally indicated by reference character 30 includes a page element 31 having a plurality of suitably integrated laminae 32, 33 and 34, in accordance with prior art teachings. The page element is bounded by a pair of exposed outer surfaces 35 and 36. First areas are secured to one of the surfaces 35 and 36. Second areas 41 are mutually abutted, as in the prior art, and third areas 42 engage oppositely disposed surfaces of an extruded synthetic resinous channel forming member 43. The member 43 includes a planar body 44 having first and second surfaces 45 and 46 which meet in a hollow beaded edge 47 which frictionally retains the prior art wire 48.

It will be observed that the device 30 is assembled without the need of any manual folding operation whatsoever. All that is necessary is the positioning of the channel forming member 43 adjacent the bound edge of the page element 31, and the pressing of the tape strips 38 and 39 into position. Once positioned, the webs which supply the tape strips 38 and 39 as well as the channel forming member 43 may be simultaneously severed to complete the page. The insertion of the wire may be done as a simple manual operation at another manufacturing station as a separate and distinct step.

I wish it to be understood that I do not consider the invention limited to the precise details of structure shown and set forth in this specification, for obvious modifications will occur to those skilled in the art to which the invention pertains.

I claim:

1. In a pivotally mounted photo album page of a type including a planar page element having a rectilinear edge, and means for engaging said edge forming a hinged interconnection with a binder, said means including a wire segment lying in the plane of said page element having free ends projecting laterally of said page element, the improvement in said last-mentioned means comprising: a generally planar channel forming element including a body of extruded synthetic resinous material having first and second opposed surfaces and a rectilinear hollow beaded edge defining a cylindrical channel therein, said wire being disposed in said channel to be frictionally retained thereby; and first and second adhesive tape strips, each strip interconnecting a surface of said page element with a surface of the body.

2. The improvement set forth in claim 1, further characterized in each of said adhesive tape strips including a laterally medially disposed area in contact with a corresponding area of the other of said tape strips.

* * * * *